US005943707A

United States Patent [19]

Bergenwall

[11] Patent Number: 5,943,707

[45] Date of Patent: Aug. 31, 1999

[54] SHOWER DEVICE

[76] Inventor: Henning Bergenwall, Aspvägen 26 B S-19141, Sollentuna, Sweden

[21] Appl. No.: 08/943,111

[22] Filed: Oct. 3, 1997

[51] Int. Cl.[6] ..... A47K 3/22; E03D 9/08

[52] U.S. Cl. ..... 4/300.003; 4/420.004; 4/447; 4/448

[58] Field of Search ..... 4/420.4, 448, 447, 4/300.3

[56] References Cited

U.S. PATENT DOCUMENTS

| | | | |
|---|---|---|---|
| 2,344,561 | 3/1944 | Popil . | |
| 3,513,487 | 5/1970 | Palermo et al. | 4/420.4 |
| 3,605,124 | 9/1971 | Marcard et al. . | |
| 3,914,803 | 10/1975 | Gregovski | 4/300.3 |
| 4,348,776 | 9/1982 | Sarjeant | 4/300.3 |
| 4,391,004 | 7/1983 | Kawai et al. | 4/420.4 X |
| 4,807,311 | 2/1989 | Ingels | 4/420.4 X |
| 4,926,509 | 5/1990 | Bass | 4/420.4 X |
| 4,998,300 | 3/1991 | Sharifzadeh | 4/420.4 |
| 5,566,402 | 10/1996 | Agha El-Rifai et al. | 4/420.4 |

FOREIGN PATENT DOCUMENTS 399 356 2/1978 Sweden .

WO96/31666 10/1996 WIPO .

OTHER PUBLICATIONS

Sanett, Busck & Co. AB, 14, "Bidetillsats som monteras pa toalettstolen" Handikappmassan, Alvsjo May 22, 1989.

*Primary Examiner*—David J. Walczak
*Assistant Examiner*—Kathleen J. Prunner
*Attorney, Agent, or Firm*—Jacobson, Price, Holman & Stern, PLLC

[57] ABSTRACT

A shower device for a toilet seat includes a shower head, a water supply conduit leading thereto, and a carrier on which the shower head and at least a portion of the conduit are arranged and which is moveably arranged in relation to a support construction to move the shower head in a pivoting movement between an active position in which the shower head is located for giving a person sitting on the toilet seat a shower from beneath in his or her seat region, and an inactive position in which the shower head is brought aside. The carrier and thereby the shower head, are pivotable around a generally vertical axis to effect the pivoting of the shower head in a generally horizontal plane of pivoting.

10 Claims, 5 Drawing Sheets

SHOWER DEVICE

FIELD OF THE INVENTION AND PRIOR ART

This invention relates to a shower device for a toilet seat, comprising a shower head, a water supply conduit leading thereto, and a carrier on which the shower head and at least a portion of the conduit are arranged and which is movably arranged in relation to a support construction to move the shower head in a pivoting movement between an active position in which the shower head is located to give a person sitting on the toilet seat a shower from beneath in his or her seat region, and an inactive position in which the shower head is brought aside.

The term "give a shower" here used should be seen in a wide perspective. Accordingly, it is supposed to comprise anything from a well spread shower to a rather concentrated spraying or washing. The invention also includes that the shower head is variable in the meaning that the character of the shower can be adjusted in a way known per se or optionally. At a known device of the type mentioned above the carrier is turnably arranged around a horizontal axis, which will lead to the shower head being pivoted in a vertical plane. This gives the disadvantage in that the spraying direction of the shower head will vary as a function of the turning position of the turnable carrier around the horizontal axis. Apart from this being felt as unsatisfying from a cleaning point of view it can also render the user the very uncomfortable consequence in that unintentionally misdirected shower streams will soak clothes, assisting persons or other objects in the surrounding. Furthermore, it has turned out to be difficult for the user to get control over the position and the direction of the shower head at any given time. As the shower head, as a consequence of the turnability of the carrier around a horizontal axis, will describe an arc-shaped pivoting movement in a vertical plane, it is difficult to obtain an optimum weighing of the movement path of the shower head so that, on one hand, the shower head is in optimum position where it is to be used for shower purposes, and, on the other hand, the shower head is positioned in a well distanced, protected position when it is not to be used. Finally, a turnable embodiment of the carrier according to the known technique also reach a rather high cost for the construction of manoeuvring handle, water regulation valve and the bearing, and the support thereof.

SUMMARY OF THE INVENTION

The object of the present invention is to further develop the initially stated prior art in such a way that the shower device associates an uncomplicated and thereby cheap constructional embodiment with good manoeuverability.

According to the invention this object is obtained by the carrier, and thereby the shower head, being pivotable around a generally vertical axis to effect the pivoting of the shower head in a generally horizontal plane of pivoting.

Accordingly, the spraying direction of the shower head will thereby be generally the same during the whole pivoting movement, which reduces the risk for unintentional showers in wrong direction. Furthermore it becomes substantially easier for the user or an assisting person to manoeuvre the carrier and thereby set the shower head in its optimum position when the carrier is pivotable around a vertical axis in a way according to the invention. Finally, this pivotability also leads to a relatively uncomplicated embodiment as a consequence of the whole carrier being pivotably positioned on the support construction and the water supply system, that is the shower head, the water supply conduit and a valve for regulating the water supply, being positioned on the very carrier.

BRIEF DESCRIPTION OF THE DRAWINGS

With reference to the attached drawings, a more detailed description of embodiments of the invention, presented by way of example, will follow hereinbelow.

On the drawings.

DETAILED DESCRIPTION OF PREFERRED EMBODIMENTS

The embodiment according to FIGS. 1–5

The shower device according to the invention comprises a shower head, a water supply conduit 2 leading thereto, and a carrier 3 on which the shower head 1 and at least a portion of the conduit 2 are arranged.

Figure 1:
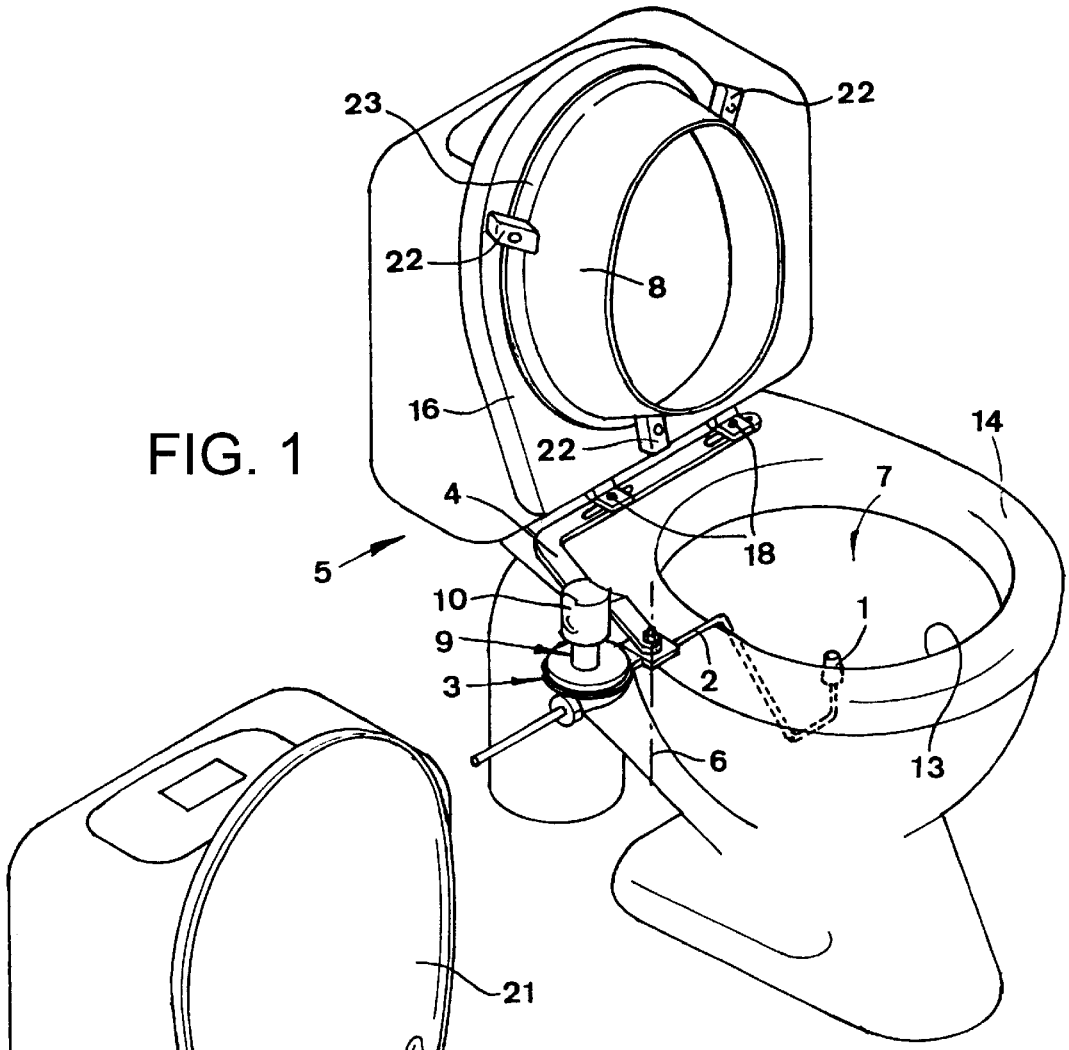
FIG. 1 is a perspective view illustrating a toilet seat provided with the shower device according to the invention, a part forming a sitting surface with attached, splash guarding mantle being illustrated in swung up position.
Figure 2:
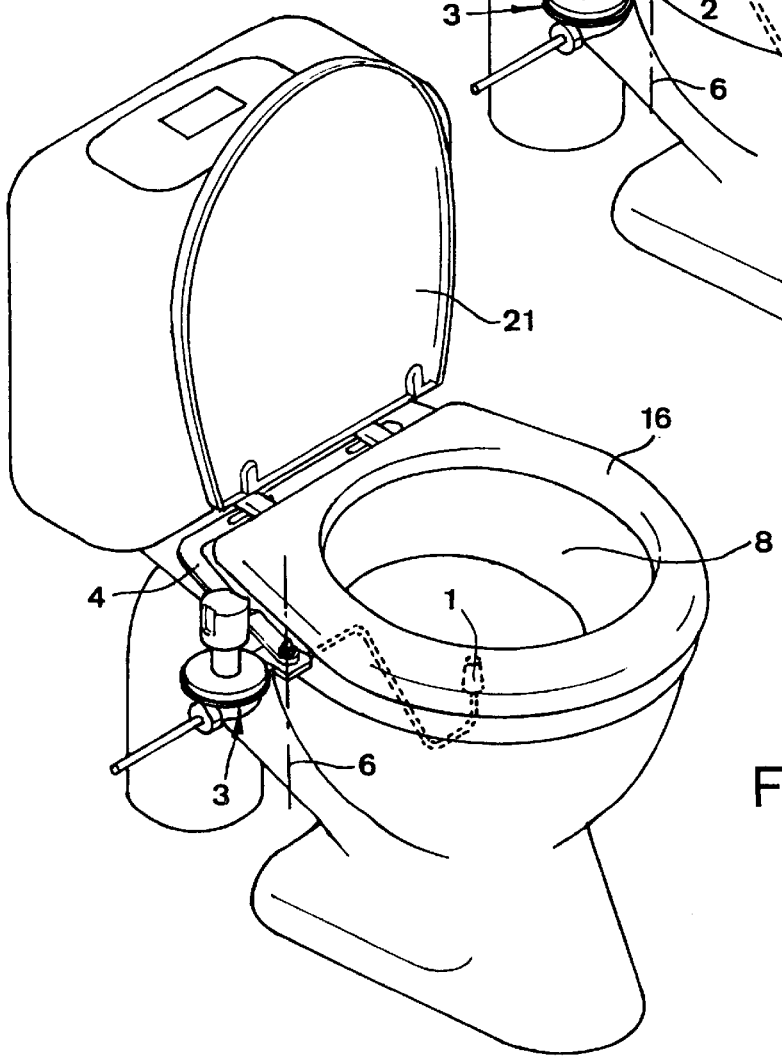
FIG. 2 is a view similar to the one of FIG. 1, but illustrating the part forming a sitting surface as swung down.
Figure 3:
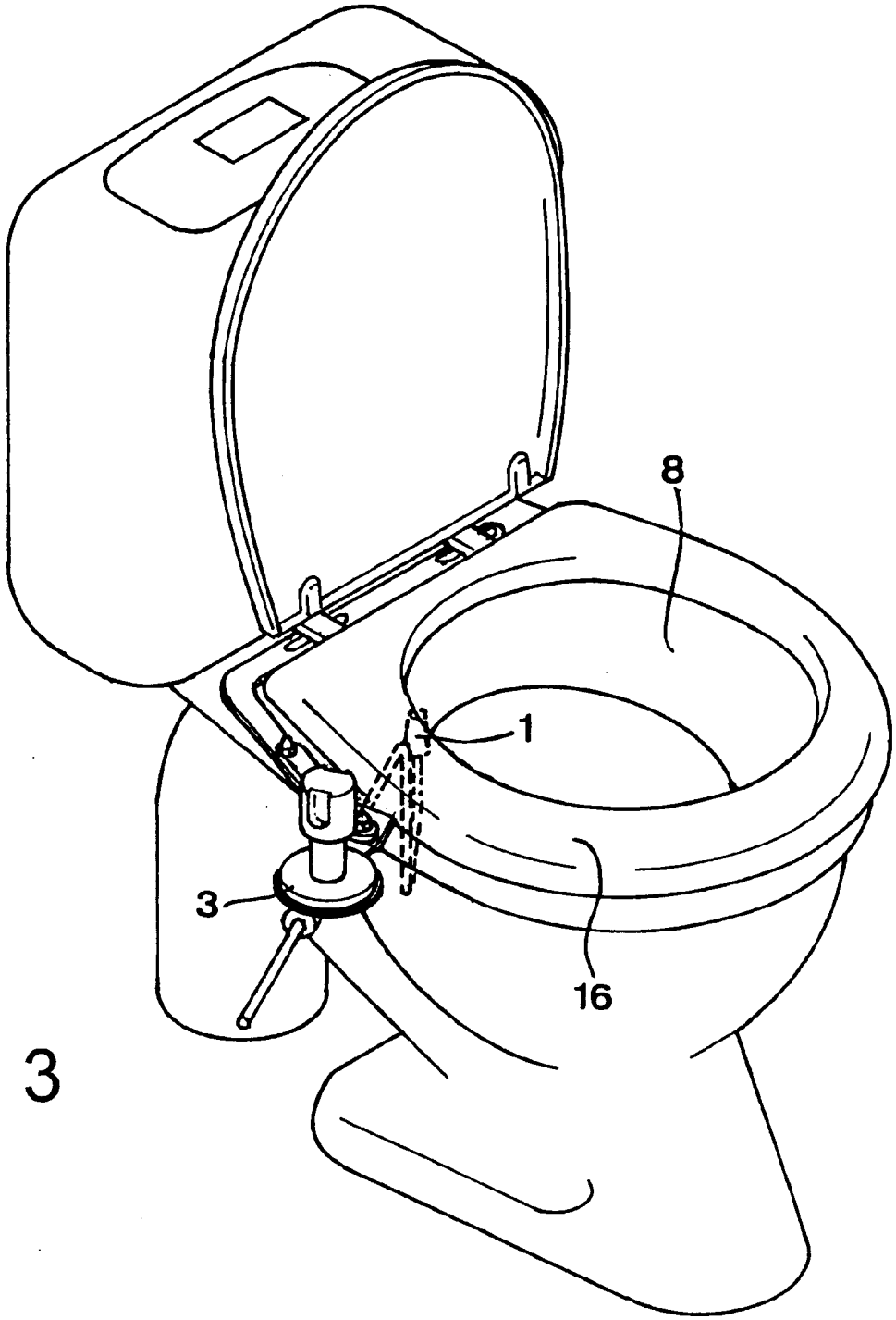
FIG. 3 is a view similar to the one of FIG. 2, but showing the shower device in another position.

The carrier 3 is movably arranged in relation to a support construction 4 to move the shower head 1 in a pivoting motion between an active position, seen in FIGS. 1 and 2, in which the shower head is located to give a person sitting on the toilet seat, which is generally referred to with 5, a shower from beneath in his or her seat region, and an inactive position, as seen in FIG. 3, in which the shower head 1 is brought aside. The carrier 3, and thereby the shower head 1, are pivotable around a generally vertical axis 6 to effect the pivoting of the shower head 1 in a generally horizontal plane of pivoting.

The device comprises a mantle 8 protruding down into a bowl 7 of the toilet seat. In the example, this mantle has a tube-like shape. In its active position, the shower head is, as seen from above, located within the width of the lower opening of the mantle 8, and in its inactive position the shower head is located beside this width. More precisely, the shower head 1 is thereby supposed to be located as in FIG. 3, that is in-pivoted behind a rear portion of the mantle 8, so that a person sitting on the toilet seat can execute his or her needs that are normally executed on the toilet seat without the shower device, and particularly the shower head 1 thereof and the conduit running up to the latter, being in the way.

A valve 9 for regulation of the water supply to the shower head 1 is arranged on the pivotable carrier 3.

A handle for manoeuvring the pivoting movement of the carrier is arranged on the pivotable carrier 3.

In the illustrated example, the valve 9 or at least a part thereof forms the desired manoeuvring handle. In the example the valve 9 comprises a moveable manoeuvring member 10. It is this movable manoeuvring member 10 of the valve 9 which forms the manoeuvring handle for the carrier 3 in the example.

In the example, the manoeuvring member 10 for the valve 9 is designed as being turnably moveable. This is no necessity, and the moveable manoeuvring member 10 can be moveable in other aspects for water regulation. In the case of a turnable manoeuvring member, it is pointed out that this does not need to be turnable around a generally vertical axis, as can be seen from the drawing figures, but that the turnability could take place around turning axes orientated in another way. However, it has turned out to be possible to obtain not only good water regulation, but also good manoeuvrability for the very carrier by means of a manoeuvring member which is turnably arranged around a generally vertical axis and which also forms a manoeuvring handle for the carrier 3.

The carrier 3, along with the shower head 1 with the conduit 2 belonging thereto, form a double-arm lever, on the arm 11 of which the shower head 1 is attached and on the other arm 12 of which the handle 9, 10 is located.

The pivot axis 6 of the carrier 3 is located outside an edge 14 which delimits the opening 13 of the toilet seat 5.

The water supply conduit 2 extends over the toilet seat edge 14 and is movable inside a space 15 between this edge 14 and a part 16 which forms a sitting surface and is arranged thereover. Normally, this one has the character of a seat ring.

Figure 4:
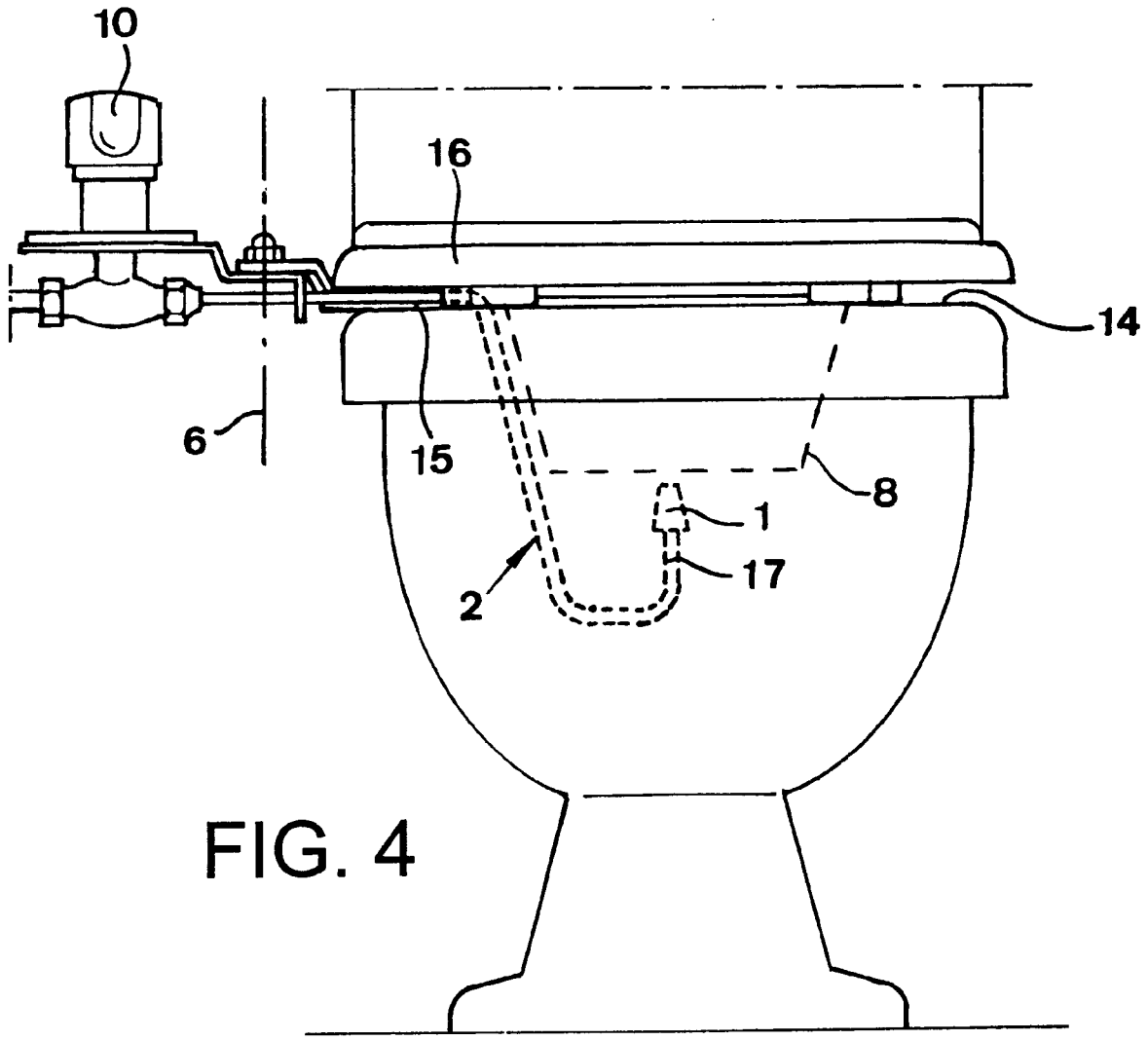
FIG. 4 is a view of the toilet seat and the shower device as seen from the front.
Figure 5:
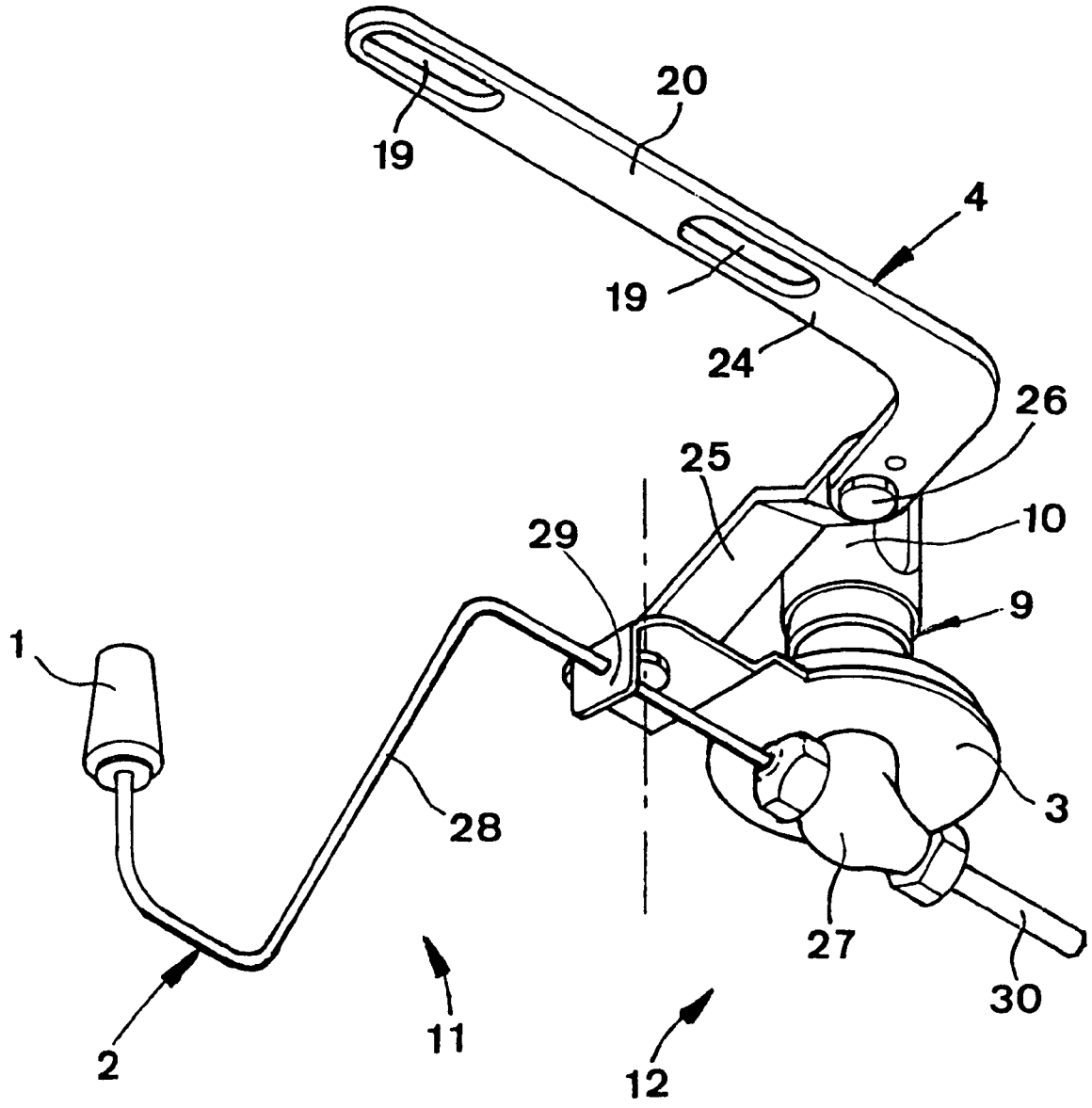
FIG. 5 is a perspective view of the shower device in isolation.

In FIG. 4 it is illustrated how the mantle 8 projects down into the toilet bowl 7 and how the conduit 2 running to the shower head 1 will pass over the toil bowl edge 14 and thereafter extend obliquely downwards in the toilet bowl between the inside of the latter and the mantle 8, the conduit 2 in the nearness of the shower head 1 being bent so that the end portion 17 of the conduit extends upwards and will be ended by the shower head 1. To obtain an embodiment which is advantageous from a hygienical point of view, this one can present easily mountable and demountable shower mouth pieces of disposable character or of an easily cleanable design.

The support construction 4 is attachable to the toilet seat 5 by means of the attachment members 18 (see FIG. 1) which also attaches the part 16, which forms a sitting surface, to the toilet seat. These attachment members 18 normally have the character of shafts projecting into and/or through holes arranged in the toilet seat edge behind the toilet bowl 7. These shafts can either present means which by means of friction engage with the limitation walls in the holes in the toilet bowl edge or, alternatively, these shafts can extend totally through the holes and, at the bottom, be engaged wit nuts or other fixing elements. As can be most clearly seen in FIG. 5, the support construction 4 present holes or slots 19 arranged to be protruded by the described attachment members 18, so that the portion 20 presenting the holes or slots 19 will be fixed by the support construction 4 against the toilet seat in a position between the upper edge surface thereof and portions of the attachment members 18 or parts belonging to the seat ring unit 16.

As can be seen in FIGS. 2 and 3, the seat ring 16 can have a tiltable lid 21. As can be seen in FIG. 1, the seat ring 16 with the mantle 8 belonging thereto can be tilted up while the attachment members 18 still retain the seat ring 16 in relation to the toilet seat.

The mantle 8 is fastened in relation to the part 16 forming a sitting surface. According to a possible embodiment the mantle 8 could be designed in one piece with the part 16 which forms a sitting surface. According to the embodiment shown in the Figure the mantle 8 is, however, arranged to have the character of a separate part or an additional part which, by means of holders 22, is fixed to the underside of the part 16 which forms the sitting surface. The holders 22 may have the character of blocks which, by means of screws or the like, are fixed to the part 16 which forms the sitting surface. Thereby, the blocks 22 may engage with a flange 23 arranged on the mantle 8.

According to a preferred embodiment the holders or blocks 22 form distance members which locate the underside of the part 16 which forms the sitting surface at a level above the upper surface of the edge 14 of the toilet bowl, so that the already described space 15 is formed therebetween. In the alternative embodiment already mentioned, where the mantle 8 is designed in one piece with the part 16 which forms the sitting surface, it is preferred that the distance keeping members are designed in one piece with the part 16 which forms the sitting surface as projections from the latter, whereby it is of course equivalent to, instead, provide the space 15 by means of a recess designed in the underside of the part 16 which forms the sitting surface.

As can be seen from the figures the support surface 4 has the character of an angled arm, where one shank forms the portion 20 which presents the holes or slots 19 for attachment to the toilet seat, while the other shank is connected with its outer end to the carrier 3 through a hinge which forms the vertical pivot axis 6. In the example, the hinge is formed by a tap or bolt extending to said shank and a portion of the carrier 3.

The support construction 4 can be composed by two parts 24, 25, which are interconnected by means of a fixing member 26, for example a bolt or screw. Alternatively, the support construction 4 also can be formed by one single material piece. The valve 9 is fixed to the carrier 3 at a distance from its pivot axis 6 in relation to the support construction 4. As is most clearly shown in FIG. 5 the valve 9 presents a valve housing 27, in which the valve member which is moveable by means of the manoeuvring member 10 can be brought to act opening or throttling regarding the water supply to the shower head 1.

The conduit, which is generally referred to with 2, comprises a rigid portion 28 which extends from the valve housing 27 to the shower head 1 with the illustrated, bent shape, the conduit extending through a support 29 arranged on the carrier 3 for the conduit. In the example, this support 29 has the character of a flap of the carrier, which flap is bent downwards and which is provided with a hole for passage of the conduit with relatively tight fitting.

Moreover, the conduit 2 comprises a portion 30 which extends from the valve housing 27 to a suitable water resource. Even if, in reality, other embodiments can be possible, a preferred embodiment is that the conduit portion 30 is formed by a flexible hose which extends to a mixing aggregate which is arranged at a suitable place, for example at the wall beside the toilet seat, and is arranged to mix hot and cold water in required portions, so that a pleasant temperature of the water leaving the shower head 1 can be obtained. Thereby, the mixing aggregate is suitably of thermostatical type. By such an embodiment the valve 9 is a simple volume regulation valve without capacity to mix cold and hot water. According to an alternative embodiment of the invention it would, however, be possible to arrange a mixing valve, for instance of thermostatical type, on the carrier 3, something which requires that cold and hot water conduits are drawn to this valve.

The shower device is used in the following way: when a person is to execute his or her needs at the toilet seat the shower device is located in the position according to FIG. 3, that is with the shower head 1 pivoted outside the width of the lower opening of the mantle 8. As said needs accordingly have been executed, the user can use the shower device for cleaning purposes. Thereby, the user initially sees to that a certain water spraying takes place so that the right temperature of the water reaching the shower head 1 can be obtained. Thereafter the user can comfortably pivot the shower head 1 forward to a required position by pivoting the carrier 3 around the axis 6. As the right position has been obtained, the user can easily open the valve 9 to a required degree, and thereby, through the shower head 1, a pleasant cleaning shower is obtained at the required place. As the user finds that the cleaning operation has obtained the required result, the valve 9 is shut and the carrier 3 is pivoted so that the shower head 1 once again is located in the position according to FIG. 3.

Figure 6:
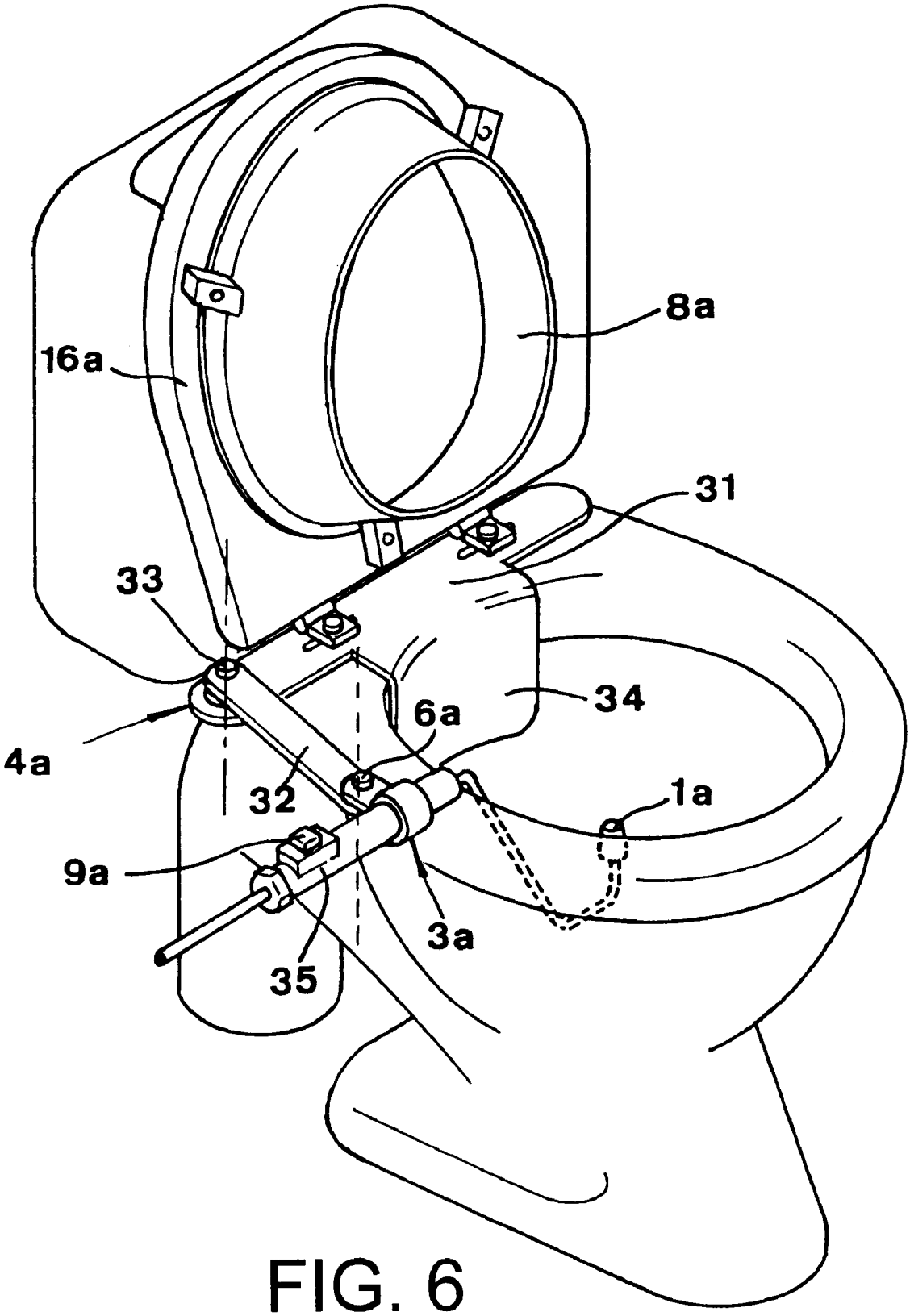
FIG. 6 is a view similar to the one of FIG. 1 of an alternative embodiment.

The embodiment according to FIG. 6

In FIG. 6 an alternative to the already described embodiment is illustrated. In FIG. 6 the same reference numerals will be used for the same or similar parts as in the foregoing embodiments, but only with the addition of the letter a.

In FIG. 6 the support construction 4*a* is shown as formed by two parts 31, 32, which are moveable in relation to each other and the first 31 of which forms a base part which is attachable to the toilet seat, while the other 32 is pivotable in relation to the base part around a second, generally vertical axis 33. The carrier 3*a* is pivotably arranged in relation of the second part 32 around the generally vertical axis 6*a* first mentioned.

The two axes 6*a* and 33 are located at a mutual distance, which means that the movements of the shower head 1*a* will be formed by the sum of two pivoting movements, namely the pivoting movement of the carrier 3*a* around the axis 6*a* in relation to the part 32 and the pivoting movement of the latter around the axis 33 in relation to the base part 31. Thereby the maneouver possibilities of the user also increase as to the position of the shower head 1*a*.

The pivotable part 32 has the character of a link extending from the region of the rear part of the toilet bowl in a forward direction to approximately the intermediate region of the toilet bowl, the part 32 being located on one side of the toilet bowl.

In this embodiment the base part 31 presents a screen piece 34 which projects down into the toilet bowl in the area of the rear part of the toilet bowl. The shower head 1*a* can be pivoted behind this screen piece so that, accordingly, the shower head 1*a* obtains a position in which it is protected by the screen piece 34 also when the part 16*a* which forms the sitting surface and the mantle 8*a* connected thereto are swung up to the position according to FIG. 6.

In the embodiment according to FIG. 6 the handle 35 has a generally rod-like shape, the diametrical axis of the rod-shape extending generally horizontally. At the handle 35 a valve 9*a* is arranged for regulation of the water supply to the shower head 1*a*. The valve could, in a simple embodiment, only permit on and off turning of the water supply, but could, in a more advanced embodiment, also permit flow volume regulation.

During use of the embodiment according to FIG. 6, the user can manoeuver the shower head 1*a* by holding the handle 35, not only by means of pivoting movement around the vertical axis 6*a* but also by bringing the part 32 to pivot in relation to the part 31 around the axis 33. This means that the shower head 1*a* is substantially moved in the forward/backward direction of the toilet seat by pivoting around the axis 6*a*. By pivoting the part 32 in relation to the part 31 the shower head 1*a* will, in the main, be movable in the cross-wise direction of the toilet bowl. The particular advantage from the freedom of motion of the shower head 1*a* around two pivot axes 6*a* and 33 arranged at mutual distance, is that the shower head 1*c* can be brought to move back and forth generally in the intermediate region of the toilet bowl in the forward/rearward direction thereof by suitable weighing of the pivoting movement components around each of these axes.

Of course, the invention is not just delimited to the embodiments having being exemplified on the drawings and described above. Accordingly, a lot of modifications of the practical embodiment can take place within the frame of the invention.

I claim:

1. A shower device for a toilet seat, comprising a shower head, a water supply conduit leading thereto, and a carrier on which the shower head and at least a portion of the conduit are arranged and which is moveably arranged in relation to a support construction to move the shower head in a pivoting movement between an active position in which the shower head is located within a bowl of the toilet seat to give a person sitting on the toilet seat a shower from beneath onto his or her seat region, and an inactive position in which the shower head is brought aside but remains within the bowl, the carrier, and thereby the shower head, being pivotable around a first, generally vertical axis to effect the pivoting of the shower head in a generally horizontal plane of pivoting, the support construction being formed by two parts which are mobile in relation to each other, a first of the two parts forming a base part which is attachable to the toilet seat, while a second of the two parts being pivotable in relation to the base part around a second, generally vertical axis, the carrier being pivotably arranged in relation to the second part around the first, generally vertical axis, said second part having the character of a link, the link extending from the region of the rear part of the toilet bowl in a forward direction to approximately the intermediate region of the toilet bowl, said link being located on one side of the toilet bowl.

2. A device according to claim 1, further comprising a mantle projecting down into a bowl of the toilet seat and the shower head, as seen from above, is positioned within the periphery of the lower opening of the mantle in its active position and is positioned beside the periphery of the lower opening in its inactive position.

3. A device according to claim 2, wherein the mantle is fixed in relation to or designed in one piece with a part which forms a sitting surface.

4. A device according to claim 1, wherein a valve for regulation of water supply to the shower head is arranged on the pivotable carrier.

5. A device according to claim 4, wherein at least a part of the valve forms a handle for maneuvering the pivoting movement of the carrier.

6. A device according to claim 1 wherein a handle for maneuvering the pivoting movement of the carrier is arranged on the pivotable carrier.

7. A device according to claim 6, wherein the carrier and the shower head with the conduit belonging thereto form a double arm lever, on one arm of which the shower head is arranged and on the other arm of which the handle is arranged.

8. A device according to claim 1, wherein the pivot axis of the carrier is located outside an edge which delimits an opening of the bowl of the toilet seat.

9. A device according to claim 8, wherein the water supply conduit extends over the toilet bowl edge and is mobile in a space between said edge and a part which forms a sitting surface and is arranged thereabove.

10. A device according to claim 1, wherein the support construction is attachable to the toilet seat by attachment members which also attach a part, which forms a sitting surface, to the toilet seat.

* * * * *